United States Patent [19]

Di Pietro

[11] Patent Number: 4,586,482

[45] Date of Patent: May 6, 1986

[54] TOY BLOW GUN

[76] Inventor: Vincent Di Pietro, 266 Granite Ave., Quincy, Mass. 02169

[21] Appl. No.: 648,083

[22] Filed: Sep. 7, 1984

[51] Int. Cl.[4] ..... F41B 1/00; A63H 33/40; A63H 33/30

[52] U.S. Cl. ..... 124/62; 446/202; 446/473

[58] Field of Search ..... 446/176, 202, 473; 124/62, 63; 52/712, 702; 248/231.8, 300, 221.4

[56] References Cited

U.S. PATENT DOCUMENTS

| | | | |
|---|---|---|---|
| 278,005 | 5/1883 | Fredricks et al. | 124/62 |
| 565,423 | 8/1896 | Beck et al. | 124/62 |
| 632,838 | 9/1899 | Jacobs | 124/62 |
| 1,290,050 | 1/1919 | Bay et al. | 124/62 |
| 2,460,924 | 2/1949 | Dally | 124/62 |
| 2,679,838 | 6/1954 | Thompson | 124/62 |
| 2,888,003 | 5/1959 | Swanson | 124/62 |
| 3,388,696 | 6/1968 | Hoverath et al. | 124/62 |
| 3,433,210 | 3/1969 | Schnitz | 124/62 |

FOREIGN PATENT DOCUMENTS

| | | | |
|---|---|---|---|
| 1228995 | 9/1960 | France | 124/62 |

*Primary Examiner*—Robert A. Hafer
*Assistant Examiner*—D. Neal Muir
*Attorney, Agent, or Firm*—M. Lawrence Oliverio; Jerry Cohen

[57] ABSTRACT

A toy blow gun comprising a barrel which includes a bore, a first end, a second end, a mechanism for allowing air to enter the bore with the mechanism for allowing air to enter being located on the barrel near each of the ends a greater distance from each of the ends than the maximum distance over which a human mouth is capable of extending over the ends of the barrel. The toy blow gun further comprises a blow tube which includes mechanism for sealing the mechanism for allowing air to enter the bore with the blow tube and the barrel forming a sealed blow path for blowing a projectile through the bore when the mechanism for sealing is attached to one of the ends of the barrel and sealing the mechanism for allowing air to enter the bore.

26 Claims, 15 Drawing Figures

TOY BLOW GUN

BACKGROUND OF THE INVENTION

1. Field of the Invention

This invention relates to toy blow guns and specifically to toy blow guns having child safety features and which are readily assemblable and disassemblable by a child.

2. Description of the Prior Art

Guns and blow guns having readily assemblable features have been concerned with the locking or lodging together of one or a limited number of components of the gun in a relatively complex manner. Such readily assemblable components and the guns of which they are a part are typically comprised of metal. The lodging or locking together of such metal components and gun bodies results in metal meeting metal without any consideration for sealing the surfaces of the detachable components against the leakage of air or other gaseous substances.

With respect to blow guns generally, such guns are typically intended for use by adults or careful users who would take care in the first instance to prevent the backing up of the projectile intended to be used in the guns. Seldom if ever is any means provided to prevent backup of the projectile due to accidental sucking, the provision for such a safety feature being left to the discretion of the experience of the user.

SUMMARY OF THE INVENTION

According to the present invention, there is provided a toy blow gun comprising a barrel which includes a bore, a first end, a second end and means for allowing air to enter the bore at or near each of the ends of the barrel. The means for allowing air to enter the barrel is located on the barrel near each end of the barrel at a greater distance from each of the ends than the maximum distance over which a human mouth is capable of extending over the ends. The blow gun also comprises a blow tube which includes a means for sealing the means for allowing air to enter the bore, with the blow tube and the barrel forming a sealed blow path for blowing a projectile through the bore when the means for sealing is attached to one of the ends of the barrel and sealing the means for allowing the air to enter the bore.

The toy blow gun may also include a projectile which has a predetermined length along a selected linear dimension, with the blow tube further including at least one means for restricting the projectile. The means for restricting the projectile comprises at least one projection within the blow tube which creates an aperture having a maximum linear aperture dimension which is shorter than the predetermined length along the selected linear dimension of the projectile, the aperture being thereby capable of preventing the projectile from passing through the aperture.

The blow tube of the blow gun may be comprised of a tube and a tube adaptor for connecting the tube to the barrel. The tube adaptor includes a means for sealing the means for allowing air to enter the barrel, at least one means for restricting the projectile, and a means for sealably connecting the tube adaptor to the tube, with the tube and barrel forming a sealing blow path for blowing the projectile through the bore when the means for sealably connecting is attached to the tube. The tube also preferably includes at least one means for restricting, and most preferably two means for restricting located at or near each end of the tube.

The means for sealing the means for allowing the air to enter the bore preferably includes a flexibly resilient mouth which is adapted to be readily frictionally engageable at either of the ends of the barrel with the means for allowing air to enter. The flexibly resilient mouth is further adapted to be readily disengageable from either of the ends of the barrel. The means for sealably connecting the tube adaptor to the tube also preferably includes a flexibly resilient mouth which is readily frictionally engageable with an end of the tube and readily disengageable therefrom.

Within the blow tube one means for restricting is preferably located a shorter distance away from one end of the blow tube than the longest linear dimension of the projectile, thereby preventing insertion of the projectile within the blow tube such that it can be sucked out of the blow tube with any substantial amount of force. There is also preferably included within the blow tube a second means for restricting located at least as far away from the other end of the blow tube as the distance which the means for allowing air to enter the bore are located from either of the ends of the barrel.

Where the blow tube comprises a tube and a tube adaptor, the tube adaptor preferably includes a means for restricting which is located a shorter distance away from one end of the tube adaptor than the longest linear dimension of the projectile, with such means for restricting being further located at least as far away from the other end of the tube adaptor as the distance which the means for allowing air to enter the bore are located away from either of the ends of the barrel. The tube to be used in conjunction with the tube adaptor also preferably includes a first and second means for restricting, each located within the tube a shorter distance away from either end of the tube than the longest linear dimension of the projectile. The inclusion of all of the various means for restricting in the tube and in the tube adaptor thereby prevent the insertion of a projectile into the blow tube such that the projectile may be sucked out with any substantial amount of force.

The means provided for allowing air to enter the bore of the barrel preferably comprises either one or more apertures in the barrel or one or more slots in the barrel which extend inward from the ends of the barrel; and each of the means for restricting the projectile preferably comprises a ringlet within the blow tube.

Other objects, features, and advantages will be apparent from the following detailed description of preferred emobdiments taken in conjunction with the accompanying drawings in which:

DETAILED DECRIPTION OF THE INVENTION

The following discussion describes several of the more preferred embodiments of the present invention with detailed references to FIGS. 1–11.

Figure 1:
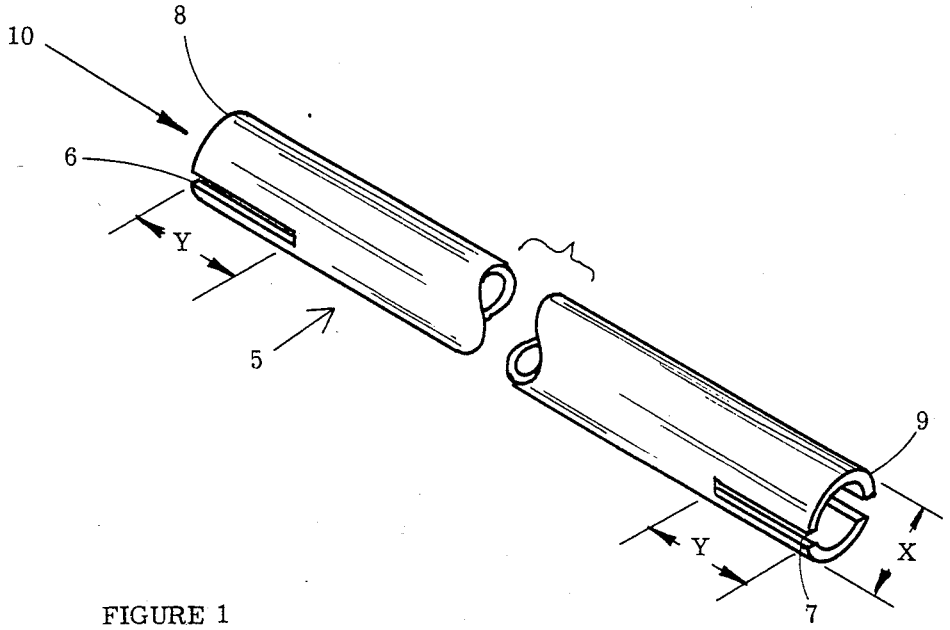
FIG. 1 is a ¾ isometric view of a barrel.

With reference to FIG. 1 a barrel 5 is depicted having an outside diameter X, a slot 6 and a slot 7 at a first end 8 and a second end 9. Slots 6, 7 extend inwardly a distance Y toward the center of the barrel 5. The distance Y is chosen to be of such a length, e.g. 12 inches, that a child or even an adult would not be able to fit their mouth over the entire length of either slot 6 or 7. Inasmuch as the length Y of slots 6, 7 is too long over which to fit one's mouth, any accidental or deliberate sucking on either end of the barrel while a projectile is located within the bore 10 of barrel 5 will be ineffectual to effect a backup of a projectile into the mouth, esophagus or otherwise. Such a backup is prevented by virtue of the presence of an open space always existing forward of the user's mouth through which air will be sucked, thereby preventing suction pressure from being able to build up sufficient to cause a back-up of a projectile. The blow tube to be used in conjunction with the barrel 5 includes means for sealing the slots 6, 7 extending inwardly from either the first end 8 or the second end 9 of the barrel 5 with the means for sealing being readily attachable to and detachable from either of the ends 8 or 9.

Figure 2:
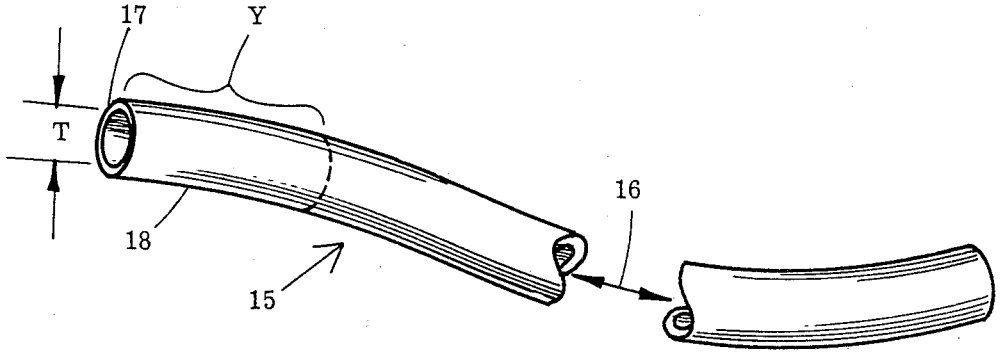
FIG. 2 is a ¾ isometric view of a blow tube.

FIG. 2 depicts a blow tube 15 having its own bore or tubular path 16. The blow tube is preferably comprised of a flexibly resilient plastic, rubber or other material which can be formed into a dimensionally stable and flexible tube. There is provided at least a flexibly resilient area 18 extending from one end 17 of blow tube 15 over a length Y of blow tube 15 at least equal in length to distance Y in FIG. 1 in order that the entirety of either slot 6 or 7 may be sealed.

Area 18, FIG. 2, preferably acts as a flexibly resilient mouth which is adapted to be readily frictionally engageable with either of ends 8, 9, FIG. 1, of barrel 5, along at least the entire length of either slots 6, 7. The inside diameter T of the portion of the bore 16 which extends through area 18 is approximately the same width as the outside diameter X of barrel 5 of FIG. 1, and preferably is slightly smaller than X.

With reference to FIGS. 1 and 2 where inside diameter T is slightly smaller than outside diameter X of barrel 5, area 18 of blow tube 15 may be sealably fitted over the entire length Y of either slot 6 or 7 by virtue of the flexible resilience of area 18. Such sealing over the entirety of one of slots 6 or 7 thereby creates a single tubular blow path or bore sealed from the leakage of air. When a suitably resilient plastic, rubber, or other material is chosen to comprise either the entirety of blow tube 15 or at least the area 18 extending over length Y of blow tube 15, the area 18 is rendered readily attachable to and detachable from barrel 5 even by a child.

Figures 3, 3A:
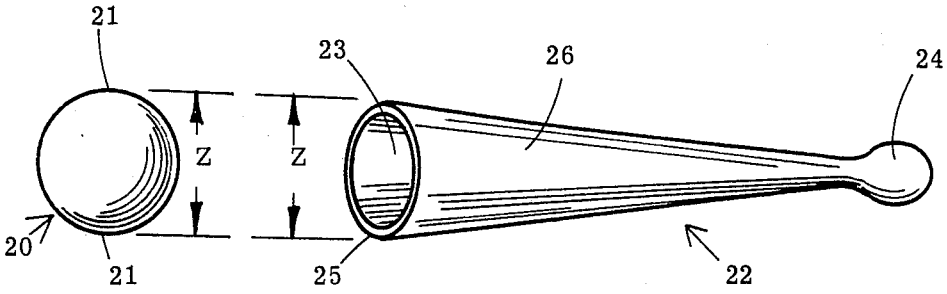
FIG. 3 is a cross-sectional isometric view of a spherical projectile cut away along a selected dimension, the diameter, Z, which is also the longest linear dimension of the spherical projectile.
FIG. 3*a* is a side isometric view of a conical projectile having a selected longest diameter dimension Z.

With reference to FIGS. 1, 2, and 3, a spherical projectile 20 is shown in FIG. 3 having a diameter Z. The length of diameter Z is preferably chosen to be approximately the same length as the inside diameter (the bore) of barrel 5, and most preferably is just slightly smaller such that when blow tube 15, is sealably attached to barrel 5, the full force of a pressure buildup due to blowing by the user on end 17 will act upon projectile 20 and not escape around edges 21 of projectile 20 when placed within the bore of barrel 5.

A preferred projectile for use in the invention comprises a hollow tubular missile having a closed end and an open end forming a closed end cavity within the missile, with the missile being adapted to be inserted within the bore by blowing air through the blow tube and into the open end of the missile.

The shape of the missile is preferably substantially conical and the closed end of the missile is blunt. Most preferably the blunt closed end of the missile is substantially spherical in shape. The cavity inside a hollow tubular cone generally possesses a greater surface area relative to the outside surface area of a spherical projectile. The greater the surface area exposed to the air being blown through the blow tube, the greater the force which will be exerted on the projectile, such that a hollow tubular projectile may be shot faster and further with the same amount of air blowing force.

Furthermore, a conically shaped projectile has more desirable aerodynamic qualities than most other geometric configurations which could otherwise be employed. The more desirable aerodynamic qualities of a conical shape further enable a projectile having such shape to travel further, faster, and with more accuracy and precision.

With reference to FIG. 3*a* there is shown a hollow projectile 22 having a substantially conically shaped body 26, a circular open end 25, a substantially spherically shaped closed end 24, and a cavity 23. The circular open end 25 has a diameter Z which is approximately slightly smaller than the inside diameter of barrel 5, FIG. 1. Although the preferred projectile 22 of FIG. 3*a* is depicted as a substantially circular cone, it may also comprise other conical shapes such as as triangular, hexagonal, octagonal, etc. A suitable hollow tubular missile for use in the present invention preferably comprise a closed end hollow tube however, and not necessarily a true cone.

Most preferably the aforementioned hollow tubular projectile further has a blunt closed end for safety purposes. As depicted in FIG. 3*a*, the blunt closed end 24 is chosen to be substantially spherical in shape. The primary concern in devising the blunt closed end 24 of projectile 22 is safety, and therefore the shape of such end may be comprised of any geometric configuration which imparts such a quality to the projectile, without detracting from the aerodynamic advantages achieved by the hollow tubular shape of the body of the projectile. It is noted that all of the discussion which follows hereinafter concerning the ability of various means for restricting and projectile restrictors to restrict the passage of projectile 20, FIG. 3, applies equally to projectile 22, FIG. 3*a*; and further all of the following discussion concerning dimension Z which is the diameter of projectile 20, FIG. 3, applies equally to dimension Z, the diameter of the circular base of projectile 22, FIG. 3*a*, because dimension Z in FIG. 3*a* is the selected linear dimension for projectile 22 for purposes of restricting its passage in the blow tube.

The blow tube of the toy blow gun described above may comprise both a blow tube adaptor and a blow tube. The blow tube adaptor is intended to act as a connector of the tube and barrel.

Figure 4:
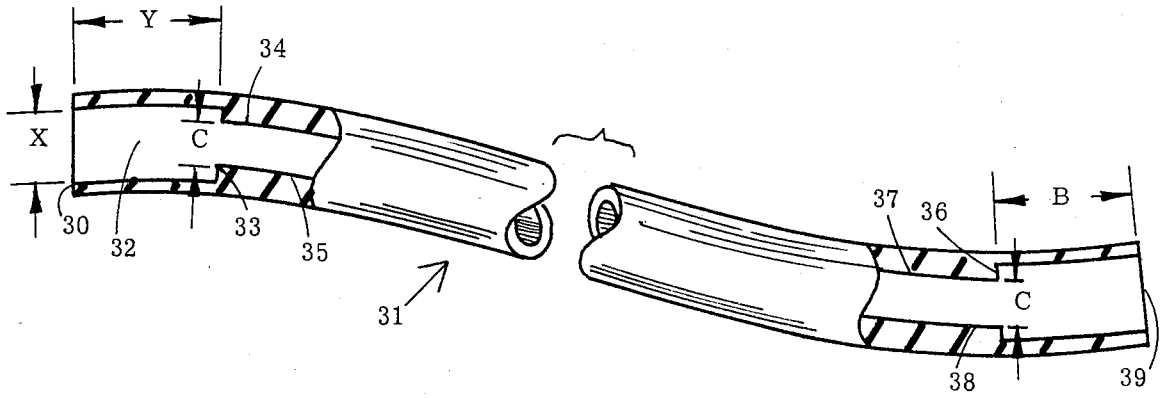
FIG. 4 is a cross-sectional side view of the safety restrictors located at either end of the blow tube.

With reference to FIG. 4 where the blow tube comprises a tube alone, one end 30 of the tube 31 is flexibly resilient over an area 32 extending over at least a length Y of the blow tube 31. The flexible resilience of area 32, the inside diameter X of end 30, and the length Y of end 30 are the same in degree as described with reference to area 18 of the blow tube in FIG. 2 such that area 32 of end 30 may act as a mouth sealably attachable by friction over the entire length Y of either slot 6 or 7 of barrel 5. Therefore length Y in FIG. 4 is at least as long as the length Y of either slot 6 or 7 of barrel 5, and inside diameter X in FIG. 4 is approximately equal to and preferably slightly smaller than the outside diameter X of barrel 5 in FIG. 1.

In the course of normal use of the blow gun, the projectile must at some point be placed into either the bore of the barrel, or the cavity of the adaptor or the tube for eventual blowing through the barrel. If the projectile is inserted into a substantial length of the tubular cavity of either the adaptor or the blow tube, the liklihood that the projectile could be sucked out with a substantial amount of force increases.

Therefore, with reference to FIG. 4, there is provided a projectile resistor (means for restricting) 33 located at least as far away from the end 30 of tube 31 as the length Y of either of slots 6,7 FIG. 1. The restrictor 33 is formed between projections 34, 35 having a diameter C which is smaller than the longest linear dimension Z of the projectile 20. The aperture is formed by projections 34 and 35 which together prevent the projectile 20 from passing through the aperture.

A second restrictor 36, FIG. 4 is also preferably included near the mouth-blowing end 39 of tube 31. The second restrictor 36 is preferably located a short distance B, FIG. 4, away from the mouth end 39. Distance B is preferably no greater in length than the diameter Z, FIG. 3, of projectile 20 in order that the projectile 20 cannot enter into the tubular path of the blow tube 31 such that it could be sucked out into the mouth with any amount of force. As in the case described with reference to restrictor 33, there are projections 37, 38 extending inwardly toward the center of the diameter of blow tube 31, forming an aperture having a diameter C which is smaller than the predetermined length along the selected linear dimension Z of projectile 20, FIG. 3, thereby preventing passage of projectile 20 through the aperture.

With reference to FIG. 4, therefore it can be seen that with two restrictors 33, 36 located near the ends 30, 39 of blow tube 31, a projectile having a predetermined length Z along a selected linear dimension, FIG. 3, cannot be inserted into blow tube 31 such that it could be sucked out of tube 31 once inserted therein with any sufficient amount of force to present a danger to the user.

In the embodiment of the blow tube 31 shown in FIG. 4, resistors 33, 36 are essentially formed by the inclusion of a tube having a smaller inside diameter C within the cavity of a tube having a larger inside diameter X, with the ends of the smaller diameter tube being located a distance Y and B away from the ends 30 and 39 respectively. In practice restrictor 36 would be unnecessary if the end of the smaller diameter tube were extended to coincide with the end 39 of blow tube 31 inasmuch as a projectile having a diameter Z, FIG. 3 would not fit within the smaller tube having diameter C. In an alternative embodiment where the form of the restrictor is chosen to be a ringlet or other projection or protuberance extending along a relatively small distance of the inside length of the tube having diameter X, location of restrictors at the positions of 33 and 36 as in FIG. 4 would be more appropriate.

Figure 5:
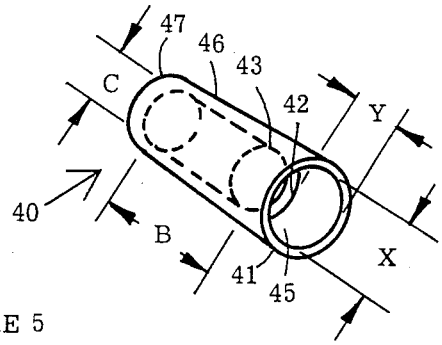
FIG. 5 is a ¾ isometric transparent view of an adaptor for connecting a tube to the barrel.

With reference to FIG. 5 where the blow tube comprises both an adaptor and a tube, the adaptor 40 is provided with a flexibly resilient area 45, and a ringlet-shaped restriction 42 forming an aperture having a diameter C which is smaller than diameter Z, FIG. 3, such that projectile 20 cannot fit or pass through restrictor 42. As in the case described with reference to restrictor 33 in FIG. 4, restrictor 42, FIG. 5, is located at least a distance Y away from the end 41 of adaptor 40, and the inside diameter of the tubular adaptor 40 is equel to and preferably slightly smaller than X, the outside diameter of barrel 5, FIG. 1. The flexible resilience of area 45 allows the area 45 of end 41 to be sealably attachable by friction over the entire length Y of either slot 6 or 7 of barrel 5, FIG. 1.

With respect to the other end 46 of adaptor 40, FIG. 5, a tube such as in FIG. 4 having a flexible resilience such that the tube is sealably attachable to either the inside or the outside of end 46 of adaptor 40. As in the case with respect to restrictor 36, FIG. 4, restriction 43, FIG. 5, is preferably located a distance B away from end 46 which is preferably no greater in length than the diameter Z, FIG. 3, of projectile 20 in order that the projectile 20 cannot enter into a tubular path such that it could be sucked out with any great amount of force.

When the blow tube comprises both a tube and a tube adaptor, the tube is most preferably chosen to include at least two restrictors such as in FIG. 4 in addition to the adaptor's including a restrictor. In such a case, the two restrictors included in the tube are preferably located no further from the ends of the tube than the longest linear dimension of the projectile, which in the case of projectile 20, FIG. 3 is diameter Z. In such a case the tube may alternatively be chosen to simply have a diameter C throughout its entire length whereby diameter C is smaller than a selected linear dimension of the projectile thereby preventing insertion of the projectile into any length of the tube whatsoever. The inclusion of such restrictors in both the adaptor and the tube thereby prevents the insertion of a projectile into either the tube, the adaptor, or the two attached.

With respect to the resilient sealing of both the end 30 of tube 31 or end 41 of adaptor 40, over the outside of barrel 5, FIG. 1, it should be noted that the outside diameters of either end 30 or end 41 may alternatively be chosen to be equal to or slightly greater than the inside diameter of barrel 5 such that sealable attachment of either tube 31 or adaptor 40 with barrel 5 may be accomplished by insertion of the flexibly resilient areas 32, 45 into, rather than around, either of the ends 8 or 9 of barrel 5. These embodiments of this paragraph are not shown in the drawings.

In either case of attachment by insertion into or surrounding an end of barrel 5, FIG. 1, with blow tube 31, FIG. 4, or adaptor 40, FIG. 5, such attachment can also be readily accomplished by virtue of the flexible resilience of areas 32, 45, FIGS. 4, 5. The flexible resilience of these areas is accomplished by choosing an appropriate rubber, plastic or other material to comprise such areas alone or the whole of blow tube 31 or adaptor 40, and by selecting the appropriate diameters or other dimensional characteristics of ends 30, 41, FIGS. 4, 5, to match the dimensional characteristics of an end 8 or 9 of barrel 5, FIG. 1.

In using the blow gun described herein, it is intended that before sealably attaching either tube, 31, FIG. 4, or adaptor 40, FIG. 5, to an end of the barrel, a projectile such as depicted in FIG. 3 should be first inserted either into end 8, 9 of barrel 5, FIG. 1, or into the space between either restrictor 42 and end 41 of adaptor 40, FIG. 5, or between restrictor 33 and end 30 of tube 31, FIG. 4. Once the projectile is so inserted and either the adaptor 40 or tube 31 is sealably attached to an end 8, 9 of barrel 5, FIG. 1, a singular tubular path is created whereby the projectile may be shot out of the barrel by blowing on the mouth end, e.g. end 39, FIG. 4, of the blow tube, without any chance of the projectile backing up through the blow tube into the mouth by accident. In the case where an adaptor 40, FIG. 5, is included as part of the blow tube to be attached to the barrel, the tube is preferably sealably attached to end 46 of adaptor 40 to comprise part of the blow tube.

The combined use of slot 6, 7 in barrel 5, FIG. 1, and the restrictors 33, 36 in tube 31, FIG. 4, and restrictor 42 in adaptor 40, FIG. 5, provides a basic operative toy blow gun which is safe for use by a child without any likly chance that the projectile can be accidentally or deliberately sucked into the mouth.

The blow gun described hereinabove also preferably comprises a tubular barrel holder including a cavity, a front end adaptor, and a rear end adaptor, each adaptor including means for aligning the barrel within the cavity and means for grasping the tubular barrel holder.

The means for aligning the barrel preferably includes flexibly resilient lips which are readily frictionally engageable around the barrel and readily disengageable therefrom. The means for grasping the barrel holder preferably includes flexibly resilient surfaces readily frictionally engageable with the tubular barrel and readily disengageable therefrom. The rear end adaptor most preferably includes a means for sighting a target.

Figure 6:
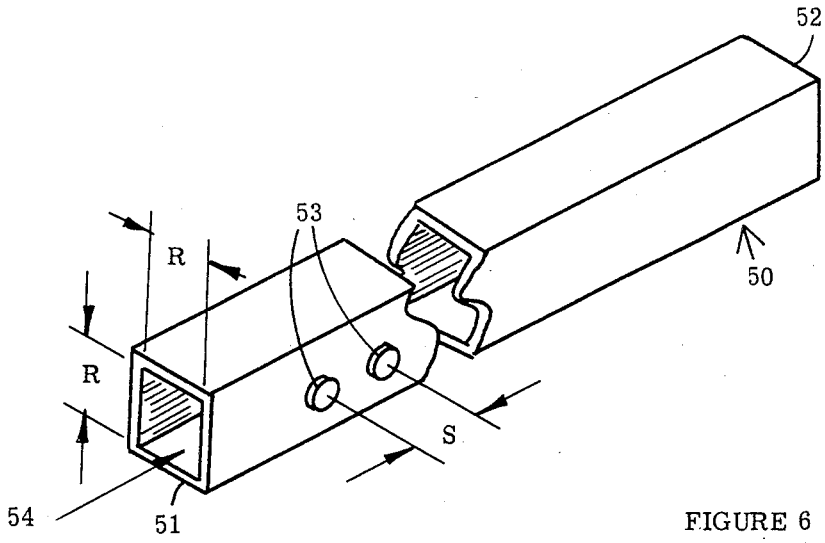
FIG. 6 is a ¾ isometric view of the barrel holder.
Figure 7A:
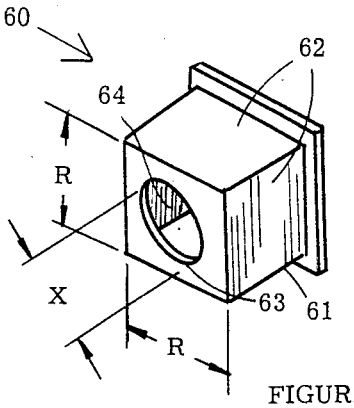
FIG. 7*a* is a ¾ isometric view of a front adaptor for connecting the barrel holder to the barrel.
Figure 7B:
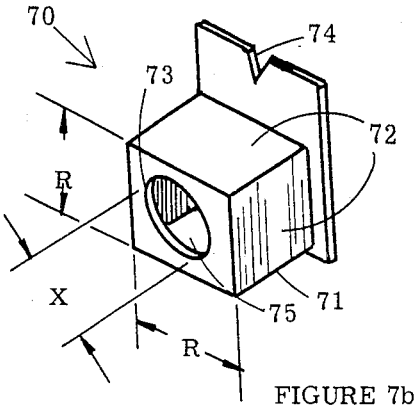
FIG. 7*b* is a ¾ isometric view of a rear adaptor for connecting the barrel holder to the barrel.

A typical barrel holder 50 is depicted in FIG. 6 wherein there is a cavity 54 for eventual insertion of the barrel. A front end adaptor 60, FIG. *7a*, and a rear end adaptor 70, FIG. *7b*, to serve to position and align the barrel 5, FIG. 1, in the barrel holder 50, FIG. 6. Rear adaptor 70 is inserted into the rear end 51 and front adaptor 60 is inserted into front end 52 of barrel holder 50. Both adaptors 70, 60 frictionally grasp the inside surfaces of the cavity 54 near ends 51, 52 of barrel holder 50 by virtue of surfaces 62, 74 having a flexible resilience and the bodies 61, 71 of adaptors 60, 70 having a dimensional configuration which is compatible with the dimensional configuration of the cavity 54 at ends 51, 52.

The bodies 61, 71 of adaptors 60, 70, FIGS. *7a*, *7b*, are square-shaped and are constructed of a dimensionally stable, flexibly resilient material such as rubber, resilient plastic or other suitable material. The shape of the cavity 54 near the ends 51, 52 of barrel holder 50, FIG. 6, is also square having a length and width R. The length and width of bodies 61, and 71 are also chosen to be equal to or slightly greater than R such that once the flexibly resilient surfaces 62, 74 are compressed to fit into the cavity 54 near ends 51, 52, the surfaces 62, 74 will expand slightly when released to frictionally grasp the barrel holder 50. Inasmuch as the dimension R of bodies 61, 71 is chosen to be just slightly larger than the dimension R of barrel holder 50, surfaces 62, 74 are readily slideable into ends 51, 52 and adpators 60, 70, are rendered readily insertable, engageable with, and disengageable from the ends 51, 52 of barrel holder 50.

Adaptors 60, 70, FIGS. *7a*, *7b* also include apertures 64, 75 for aligning the barrel 5, FIG. 1, within cavity 54, FIG. 6. The apertures 64, 75 have a diameter X approximately equal to and preferably slightly smaller than the outside diameter X of barrel 5. The flexible resilience of bodies 61, 71 renders the lips 63, 73 of adaptors *7a*, *7b* flexible and resilient to engage and hold barrel 5, FIG. 1, once inserted through aperture 64, cavity 54, and aperture 75. The choice of diameter X of apertures 64, 75 to be slightly smaller than the outside diameter X of barrel 5, FIG. 1, renders the barrel 5 readily engageable with and disengageable from adaptors 60, 70.

Rear adaptor 70, FIG. *7b*, may also include a sighting means 75 for eyeballing a target located in the path in which the barrel points.

In addition to the basic barrel, barrel holder, blow tube and other special features described hereinabove, the toy blow gun preferably further comprises a stock for aligning the tubular barrel holder, and a means for coupling the stock to the tubular barrel holder for alignment of the tubular barrel holder along the stock, the means for coupling including at least one pair of arms mounted on one of the stock or the tubular barrel holder and at least one pair of projections mounted on the other of the stock or the tubular barrel holder, the arms including means for readily connecting the stock and disconnecting it from the tubular barrel holder.

Alternatively the pair of arms may include at least one pair of projections, not shown, and at least one of the arms is adapted to be manually flexed to a position whereby the projection(s) thereon are out of engagement with associated means for receiving on the barrel holder to disconnect the stock from the barrel holder. In the case where the projections on the arms are out of engagement with the means for receiving the projections on the barrel holder, both of the arms are preferably adapted to be manually flexed to a position whereby the projections on the arms are out of engagement with the means for receiving the projections on the barrel holder.

Preferably the means for receiving the projections includes at least as many apertures as there are projections.

Figure 8:
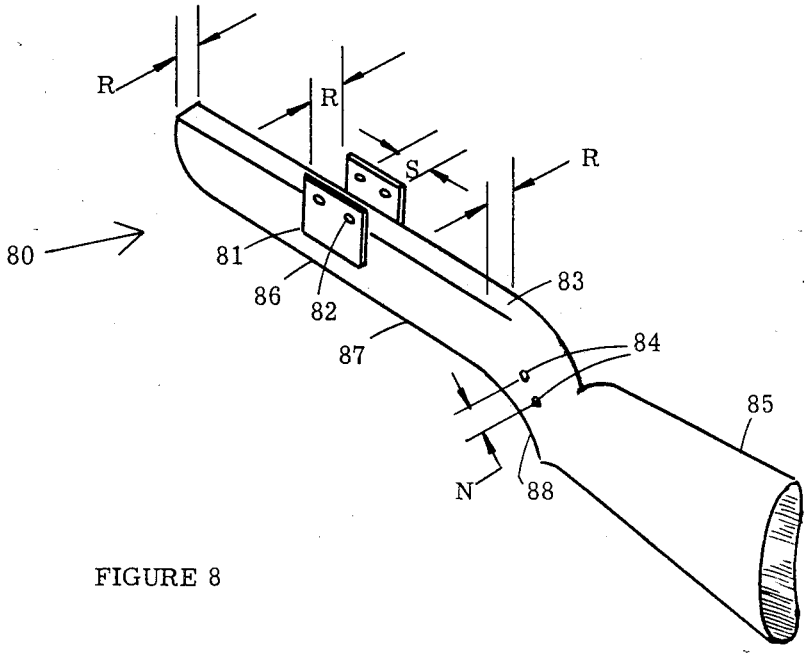
FIG. 8 is a ¾ isometric view of a stock.
Figure 9A:
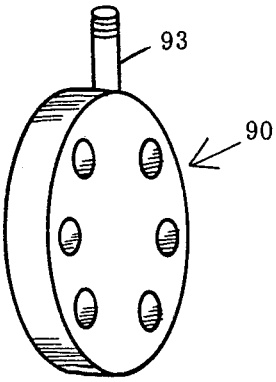
FIG. 9*a* is a perspective view of a magazine.
Figure 9B:
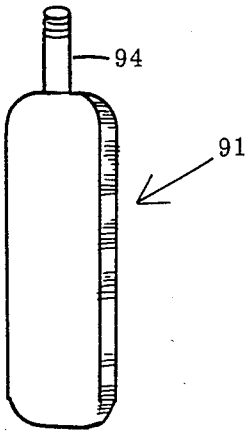
FIG. 9*b* is a perspective view of a front handle for the stock.
Figure 9C:
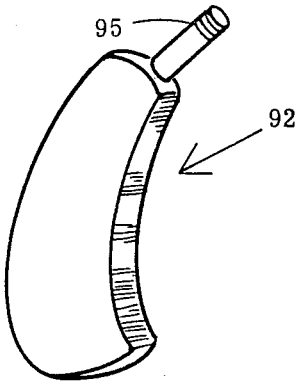
FIG. 9*c* is a perspective view of a rear handle for the stock.

With reference to FIG. 8, there is depicted a stock 80, having manually actuatable arms 81 which in turn have apertures 82 which are intended to receive projections 53, FIG. 6, jutting out from the sides of barrel holder 50, FIG. 6. The arms 81, apertures 82, and projections 53 collectively act as a means for coupling the barrel holder 50 to the stock 80.

Arms 81, FIG. 8, are preferably constructed of a flexibly resilient material such as thin metal, rubber or plastic which can be readily flexed outwardly to either allow projections 53 spaced a distance S apart, FIG. 6, to enter or to be detached from apertures 82, also spaced a compatible distance S apart, FIG. 8. At their normal unflexed position on stock 80, arms 18 are parallel to each other and spaced approximately a distance R apart from each other, about the same distance as the approximate width R of barrel holder 50, FIG. 6.

Stock 80, FIG. 8, further includes a recess 83 formed to be dimensionally compatible with barrel holder 50, FIG. 6. Recess 83 also has a width approximately equal to R into which barrel holder 50 fits. Flexing of either of arms 81, allows projections 53, FIG. 6, to be aligned with and eventually inserted into apertures 82 therby locking and aligning barrel holder 50 into recess 83 and along stock 80. The manual flexibility and resilience of one or both of arms 81, allows ready attachment and detachment of barrel holder 50 to and from stock 80.

Arms 81, FIG. 8, may alternatively include projections such as those depicted in FIG. 6, and concomitantly barrel holder 50 may be provided with apertures. It is necessary in any case to provide at least as many apertures on either barrel holder 50 or arms 81 as there are projections on the other.

Figure 10:
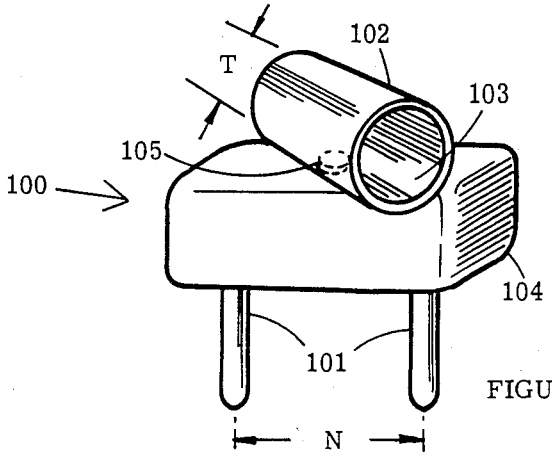
FIG. 10 is a ¾ isometric view of a blow tube holder.

There is depicted in FIG. 10 a blow tube holder 100 having a pair of projections 101 located a distance N apart from each other. Projections 101 are intended to fit into a pair of receiving apertures 84, FIG. 8, located a compatible distance N apart on the handle portion 85 of stock 80. A short tubular mechanism 102 is included on blow tube holder 100, FIG. 10, having an inside diameter T which is approximately equal to and preferably slightly smaller than the outside diameter of blow tube 15, FIG. 2. Inasmuch as blow tube 15, FIG. 2 is chosen to be constructed of a flexibly resilient material, the blow tube 15 may be readily inserted through the cavity 103 of tubular mechanism 102, FIG. 10, and held therein by the friction created by the resilience of blow tube 15, FIG. 2, against the inside surface of tubular mechanism 102.

The short tubular mechanism 102, FIG. 10, of blow tube holder 100 is attached to the body 104 of blow tube holder 100 at a pivot point 105 which enables the short tubular mechanism 102 to pivot circumferentially in a direction dictated by the user's manipulation of the blow tube 15, FIG. 2, once inserted into the cavity 103 of the short tubular mechanism 102. Due to the flexible resilience of blow tube 15, FIG. 2, and the choice of diameter T of short tubular mechanism 102, FIG. 10, to be compatible with the outside diameter of the blow tube 15, the blow tube is rendered readily attachable to and detachable from blow tube holder 100.

Projections 101, FIG. 10, are also preferably comprised of a flexibly resilient material, and also have a diameter approximately equal to or slightly greater than the diameter of apertures 84, FIG. 8. Such choice of parameter for projections 101 and apertures 84 thereby render blow tube holder 100 readily attachable to and detachable from stock 80.

FIGS. *9a, 9b,* and *9c* respectively depict a magazine 90, front handle 91, and a rear handle 92. Each of magazine 90, front handle 91, and rear handle 92, include screw mechanisms 93, 94, 95 for ready attachment to the underside of stock 80. the underside of stock 80, FIG. 8, is concomitantly provided with three female screw holes located approximately at positions 86, 87, 88 for attachment of front handle 91, magazine 90, and rear handle 92, FIGS. *9a, 9b, 9c,* respectively. Screw mechanisms 93, 94, 95 and concomitant screw holes provided in stock 80 thereby render each of magazine 90, front handle 91, and rear handle 92 readily attachable to and detachable from stock 80.

The end result of the many readily attachable and detachable parts and mechanisms of the toy blow gun described hereinabove is that a child is provided with a completedly assemblable and disassemblable toy which operates as a learning device.

Furthermore the provision of the barrel and blow tube with the air inlet safety means and safety restrictions described aboive, make it impossible to place a projectile into any unrestricted and completely sealed tubular path of any substantial length, thereby rendering it impossible to effect a forceful sucking-up of the projectile into the mouth.

Figure 11:
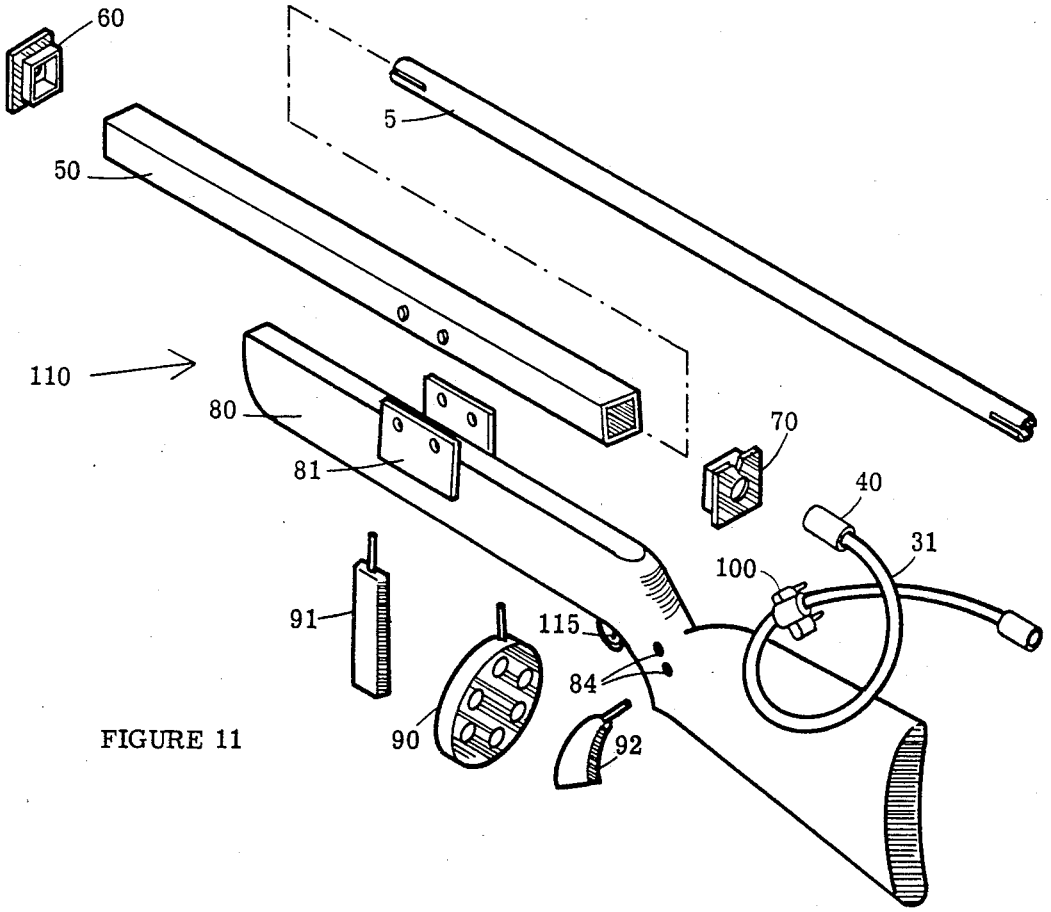
FIG. 11 is an exploded view of a toy blow gun according to the present invention.

FIG. 11 depicts in exploded view all of the readily attachable and detachable parts of the blow gun of the invention. The barrel 5 can be seen to be insertable into the barrel holder 50 and through the apertures in the adaptors 60, 70, which adaptors are themselves readily insertable into the ends of the barrel holder 50. Preferably once the barrel 5 is assembled together with the barrel holder 50 and adaptors 60, 70, the blow tube may next be attached to an end of the barrel 5 via attachment of blow tube adaptor 40 over such end so as to completely cover the means for allowing air to enter the bore (a slot as depicted in FIG. 11).

The blow tube depicted in FIG. 11 comprises a tube 31 and an adaptor 40 which are readily attachable to and detachable from each other, and are depicted as being already attached. There is also depicted the blow tube holder 100 through which the tube 31 has been inserted, and which blow tube holder is attachable to the stock 80 by insertion of the projections on the blow tube holder into apertures 120. The relative positioning of the front handle 91, magazine 90, rear handle 92, and an inoperative trigger 115 on the stock 80 is also depicted.

As can also be seen from FIG. 11, when the projections on barrel holder 50 are aligned with the receiving apertures on manually actuatable arms 81, the barrel holder 50 may be readily aligned along and attached to stock 80 by flexing one of the arms 81 and inserting the projections on the barrel holder 50 into the apertures on arms 81.

The end result of providing ready attachability and detachability of the various components of the toy blow gun as demonstrated by FIG. 11, is that a child is provided with a device which is both a toy and a tool for learning the simple assembly of mechanical parts. While FIG. 11 demonstrates the preferred assembly for use of the toy blow gun, it can be easily recognized that an operative toy blow gun can be assembled simply by attaching barrel 5 to the blow tube. It should also be recognized that various other subassemblies of the components of the toy blow gun of the present invention can be achieved which are interesting to the user of the toy.

Finally, it is noted that in all cases referred to hereinabove where a tube and an adaptor is described as being readily attachable to a barrel, or where an adaptor for aligning the barrel in the barrel holder is described as being readily attachable to the barrel holder and the barrel, the specific shapes of the barrel, barrel holder, adaptors, tubes and the like are not limited to being round, square, parallelipiped, or cylindrical as depicted. The only requirement in dimensional shape for any of these components is that the components which are intended to be attached to or inserted within or around each other, should be dimensionally compatible with each other so as to allow ready assembly and disassembly and, where appropriate, complete sealing of the attached components to prevent leakage of air or accidental disengagement due to shock or other handling.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A toy blow gun comprising:

a barrel including a bore, a first end, a second end, and means extending from an end of said tube for allowing air to enter said bore, said means for allowing air to enter being located on the barrel near each of said ends a greater distance from each of said ends than the maximum distance over which a human mouth is capable of extending over either of said ends; and a blow tube including means for sealing the means for allowing air to enter said bore, said blow tube and said barrel forming a sealed blow path for blowing a projectile through said bore when said means for sealing is attached to one of said ends and sealing said means for allowing air to enter said bore.

2. The toy blow gun of claim 1 further comprising a projectile having a predetermined width, wherein said blow tube further includes at least one means for restricting the projectile, the means for restricting comprising at least one projection within the blow tube creating an aperture having a maximum linear aperture dimension which is shorter than the predetermined width of the projectile, said aperture being thereby capable of preventing said projectile from passing through said aperture.

3. The toy blow gun of claim 2 wherein said blow tube further includes a tube and a tube adaptor for connecting the tube to the barrel, said tube adaptor including the means for sealing, at least one of said means for restricting and a means for sealably connecting said tube adaptor to said tube, said tube and said barrel forming a sealed blow path for blowing said projectile through said bore when said means for sealably connecting is attached to said tube.

4. The toy blow gun of claim 3 wherein said tube includes at least one of said means for restricting.

5. The toy blow gun of claim 1 wherein said means for sealing comprises a flexibly resilient mouth of said blow tube readily frictionally engageable with said means for allowing air to enter at either of said ends, said flexibly resilient mouth further being readily disengageable therefrom.

6. The toy blow gun of claim 3 wherein said means for sealably connecting comprises a flexibly resilient mouth of said below tube readily frictionally engageable with an end of said tube and readily disengageable therefrom.

7. The toy blow gun of claim 2 wherein a first one of said means for restricting is located within said blow tube a shorter distance away from one end of said blow tube than the longest linear dimension of said projectile, and a second one of said means for restricting is located within said blow tube at least as far away from the other end of said blow tube as the distance which the means for allowing air to enter are located away from the ends of the barrel.

8. The toy blow gun of claim 3 wherein said one of the means for restricting is located within said tube adaptor a shorter distance away from one end of said tube adaptor than the longest linear dimension of said projectile, said one of the means for restricting being further located within said tube adaptor at least as far away from the other end of said tube adaptor as the distance which the means for allowing air to enter are located from the ends of the barrel.

9. The toy blow gun of claim 8 wherein a first and second means for restricting are respectively located within said tube a shorter distance away from either end of said tube than the longest linear dimension of said projectile.

10. The toy blow gun of claim 1 further comprising:

a tubular barrel holder including a cavity;

a front end adaptor; and, a rear end adaptor; each of said adaptors including means for aligning said barrel within the cavity and means for grasping said tubular barrel holder.

11. The toy blow gun of claim 10 wherein said means for aligning includes flexibly resilient lips readily frictionally engageable around said barrel to hold said barrel and readily disengageable therefrom.

12. The toy blow gun of claim 10 wherein said means for grasping includes flexibly resilient surfaces readily frictionally engageable with said tubular barrel and readily disengageable therefrom.

13. The toy blow gun of claim 12 wherein said rear end adaptor includes a means for sighting a target.

14. The toy blow gun of claim 10 further comprising:

a stock for aligning said tubular barrel holder;

and, means for coupling said stock to said tubular barrel holder, said means for coupling including at least one pair of arms mounted on one of said stock or said tubular barrel holder and at least one pair of projections mounted on the other of said stock or said tubular barrel holder, said arms including means for receiving said projections and manually actuatable means for readily connecting said stock to and disconnecting it from said tubular barrel holder.

15. The toy blow gun of claim 10 further comprising:

a stock for aligning said tubular barrel holder;

and, means for coupling said stock to said tubular barrel holder, said means for coupling including at least one pair of arms, and means for receiving said projections, wherein each of said arms includes at least one projection, and wherein said arms are mounted on one of said stock or said tubular barrel holder and said means for receiving are mounted on the other of said stock or said tubular barrel holder, said arms including manually actuatable means for readily connecting said stock to and disconnecting it from said tubular barrel holder.

16. The toy blow gun of claim 14 wherein said manually actuatable means include at least one of said arms.

17. The toy blow gun of claim 16 wherein said one arm is flexibly resilient and is adapted to be manually flexed to a position out of engagement with its associated projection to disconnect said stock from said tubular barrel holder.

18. The toy blow gun of claim 15 wherein said manually actuatable means includes at least one of said arms.

19. The toy blow gun of claim 18 wherein said one arm is flexibly resilient and is adapted to be manually flexed to a position wherein each of said projections included in said one arm are out of engagement with said means for receiving to disconnect said stock from said tubular barrel holder.

20. The toy blow gun of claim 14 wherein said means for receiving includes at least as many apertures as there are of said projections.

21. The toy blow gun of claim 15 wherein said means for receiving includes at least as many apertures as there are of said projections.

22. The toy blow gun of claim 1 wherein the means for allowing air to enter the bore comprises one or more slots in the barrel extending inward from the ends of the barrel.

23. The toy blow gun of claim 2 wherein said means for restricting further comprises a smaller diameter tube within said blow tube.

24. The toy blow gun of claim 2 wherein said projectile comprises a hollow tubular missile having a closed end and an open end forming a closed end cavity within said missile, said missile being adapted to be inserted within the bore of said barrel and blown through and out of said bore by blowing air through the blow tube and into the open end of said missile.

25. The toy blow gun of claim 24 wherein said hollow tubular missile is substantially conical in shape and said closed end is blunt.

26. The toy blow gun of claim 25 wherein said closed end is substantially spherical in shape.

* * * * *